US010374328B2

(12) United States Patent
Bhagyanathan-Sathlanathan et al.

(10) Patent No.: US 10,374,328 B2
(45) Date of Patent: Aug. 6, 2019

(54) TERMINAL FITTING WITH HOOD

(71) Applicant: Molex, LLC, Lisle, IL (US)

(72) Inventors: Dwaraganathan Bhagyanathan-Sathlanathan, Auburn Hills, MI (US); Xin Wang, Auburn Hills, MI (US); Yves LePottier, Ann Arbor, MI (US); Bradley M. Dick, Linden, MI (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/741,810

(22) PCT Filed: Jul. 19, 2016

(86) PCT No.: PCT/US2016/042965

§ 371 (c)(1),
(2) Date: Jan. 4, 2018

(87) PCT Pub. No.: WO2017/015285

PCT Pub. Date: Jan. 26, 2017

(65) Prior Publication Data

US 2018/0212340 A1 Jul. 26, 2018

Related U.S. Application Data

(60) Provisional application No. 62/196,048, filed on Jul. 23, 2015.

(51) Int. Cl.
*H01R 4/18* (2006.01)
*H01R 13/432* (2006.01)
(Continued)

(52) U.S. Cl.
CPC ..... *H01R 4/185* (2013.01); *H01R 13/24* (2013.01); *H01R 13/432* (2013.01); *H01R 13/03* (2013.01);
(Continued)

(58) Field of Classification Search
CPC ..... H01R 4/185; H01R 13/11; H01R 13/18; H01R 13/187; H01R 13/24; H01R 13/4223; H01R 13/432; H01R 13/5205
(Continued)

(56) References Cited

U.S. PATENT DOCUMENTS 3,058,091 A * 10/1962 Henschen ..... H01R 13/111 29/874
5,951,336 A * 9/1999 Seko ..... H01R 13/432 439/745
(Continued)

FOREIGN PATENT DOCUMENTS

CN 101872914 A 10/2010
CN 103168393 A 6/2013
(Continued)

OTHER PUBLICATIONS

Extended European Search Report received for European Patent Application No. 16828417.2, dated Feb. 13, 2019, 7 pages.
(Continued)

*Primary Examiner* — Harshad C Patel
(74) *Attorney, Agent, or Firm* — Molex, LLC

(57) ABSTRACT

An electrical terminal fitting includes a body and a hood. The body is formed from a first material and includes a connection section and a contacting section with the contacting section having a flexible contact beam and stiffening beam for receiving a male pin of a mating terminal. The hood is formed from a second material having a higher tensile strength than the first material and is secured to the body. The hood includes a rib having tapered ends and a locking beam that engages a housing to secure the terminal. The locking beam further includes a stop having a rounded end.

18 Claims, 19 Drawing Sheets

(51) Int. Cl.

| | |
|---|---|
| ***H01R 13/24*** | (2006.01) |
| *H01R 13/11* | (2006.01) |
| *H01R 13/187* | (2006.01) |
| *H01R 13/18* | (2006.01) |
| *H01R 13/52* | (2006.01) |
| *H01R 13/422* | (2006.01) |
| *H01R 13/03* | (2006.01) |

(52) U.S. Cl.
CPC ..... *H01R 13/11* (2013.01); *H01R 13/18* (2013.01); *H01R 13/187* (2013.01); *H01R 13/4223* (2013.01); *H01R 13/5205* (2013.01); *H01R 2201/26* (2013.01)

(58) Field of Classification Search
USPC ..... 439/816, 845, 848–856
See application file for complete search history.

(56) References Cited

U.S. PATENT DOCUMENTS

| | | | | |
|---|---|---|---|---|
| 6,394,858 | B1 * | 5/2002 | Geltsch | H01R 13/114 439/843 |
| 6,520,801 | B2 * | 2/2003 | Tabata | H01R 13/4223 439/595 |
| 6,589,080 | B2 | 7/2003 | Tanaka | |
| 6,767,259 | B2 * | 7/2004 | Kojima | H01R 13/114 439/595 |
| 6,905,376 | B2 * | 6/2005 | Chen | H01R 13/04 439/595 |
| 7,303,447 | B1 * | 12/2007 | Tyler | H01R 9/031 439/746 |
| 2003/0049975 | A1 | 3/2003 | Tsuji et al. | |
| 2003/0096542 | A1 | 5/2003 | Kojima | |
| 2004/0209527 | A1 * | 10/2004 | Chen | H01R 13/04 439/852 |
| 2006/0172621 | A1 | 8/2006 | Noro et al. | |
| 2010/0197178 | A1 * | 8/2010 | Hotea | H01R 13/11 439/852 |
| 2012/0142233 | A1 * | 6/2012 | Blasko | H01R 13/113 439/852 |
| 2014/0322995 | A1 | 10/2014 | Frimmersdorf et al. | |
| 2017/0047677 | A1 * | 2/2017 | Bhagyanathan Sathianathan | H01R 13/113 |

FOREIGN PATENT DOCUMENTS

| | | | |
|---|---|---|---|
| CN | 103579806 | A | 2/2014 |
| EP | 1 291 979 | A1 | 3/2003 |
| JP | 2001-143807 | A | 5/2001 |
| JP | 2009-110685 | A | 5/2009 |
| JP | 2015-090786 | A | 5/2015 |

OTHER PUBLICATIONS

Notification of Reasons for Refusal received for Japanese Patent Application No. 2018-503134, dated Dec. 18, 2018, 11 pages. (Including English Translation).

* cited by examiner

TERMINAL FITTING WITH HOOD

RELATED APPLICATIONS

This application is a national stage of International Application No. PCT/US2016/042965, filed Jul. 19, 2016, which claims priority to United States Provisional Application No. 62/196,048, filed Jul. 23, 2015, both of which are incorporated herein by reference in their entirety.

FIELD OF THE INVENTION

The present disclosure relates to field of Electrical Terminal Fittings.

DESCRIPTION OF RELATED ART

The present disclosure generally relates to an electrical terminal fitting and, more specifically, to an female electrical terminal contact for a connector system that can be used in a vehicle. In general, connectors of this type are suitable for use in vehicle systems including junction distribution blocks, power control modules and other body control systems. These systems typically employ a wire harness to connect the various body and control systems throughout the vehicle.

BRIEF SUMMARY

A connector system is provided that includes a plug connector and a receptacle connector. The connector system typically includes a plug connector assembly or header assembly including a plurality of electrical conducting terminals that are coupled to a printed circuit board and a receptacle connector assembly including a corresponding number of mating electrical terminals coupled to a wiring harness. In alternative arrangements, a plug and receptacle system may both be coupled to respective ends of a wire harness. These arrangements are typically known as wire to board and wire to wire connection systems.

These connector systems includes a header or plug connector having a plurality of male electrical terminals or pins either mounted on a printed circuit board or retained in a plug or first insulative housing. A receptacle connector includes a molded exterior housing with a plurality of pockets or cavities to retain a plurality of female terminals for cooperatively mating with the first plug connector housing. Each of the respective connector assemblies include an electrical terminal fitting having a locking or retaining arm extending from the terminal and an insulative housing including a cavity with integrally molded structure engaging the retaining arm to fully retain and lock the corresponding electrical terminals on the housing.

With increased demand for smaller terminals and increased performance, the female electrical terminal in an embodiment is constructed from two separate pieces, a contacting or electrical piece and a reinforcing piece or support piece. The contacting piece made from a highly conductive metal allowing for superior electrical performance and the support piece made from a high strength material to provide superior retention force and contacting beam reinforcement.

In certain conditions, exposure to the environment cannot be avoided and a structure is needed to seal the electrical connection from moisture and debris. In these instances, a sealed system is required which involves providing a moisture resistant barrier between cooperating electrical connectors. Generally, the sealing aspect is disposed between the mating interface of the connectors and additionally at the wire end or harness end of each of the connectors. In certain instances, the terminals of the connector may need to be serviced or replaced, which involves removing a terminal lead from the connector. In these cases one can appreciate a terminal that can be removed from a connector which does not damage the seal during service.

BRIEF DESCRIPTION OF THE DRAWINGS

The present disclosure is illustrated by way of example, and not limited, in the accompanying figures in which like reference numerals indicate similar elements and in which.

DETAILED DESCRIPTION

Figure 1:
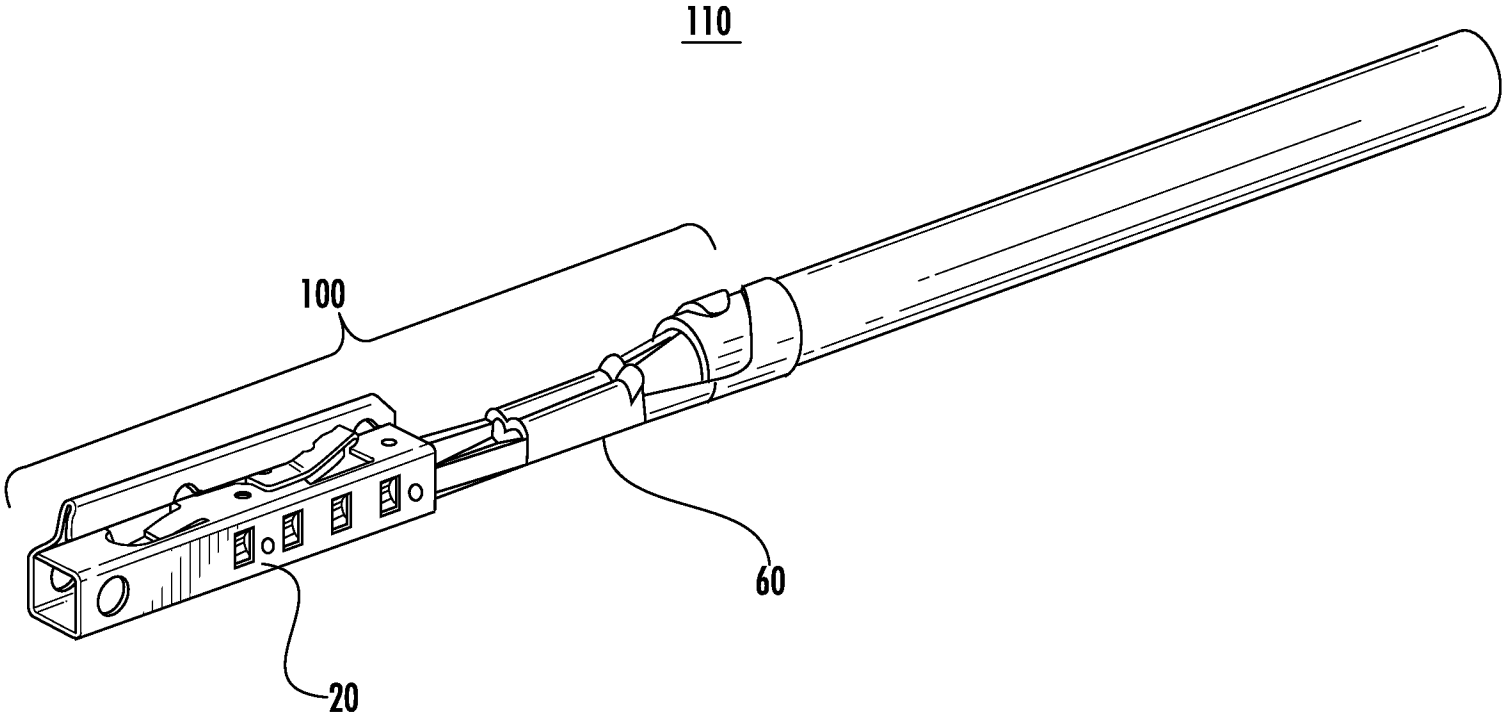
FIG. 1 is a perspective view of the terminal.
Figure 2:
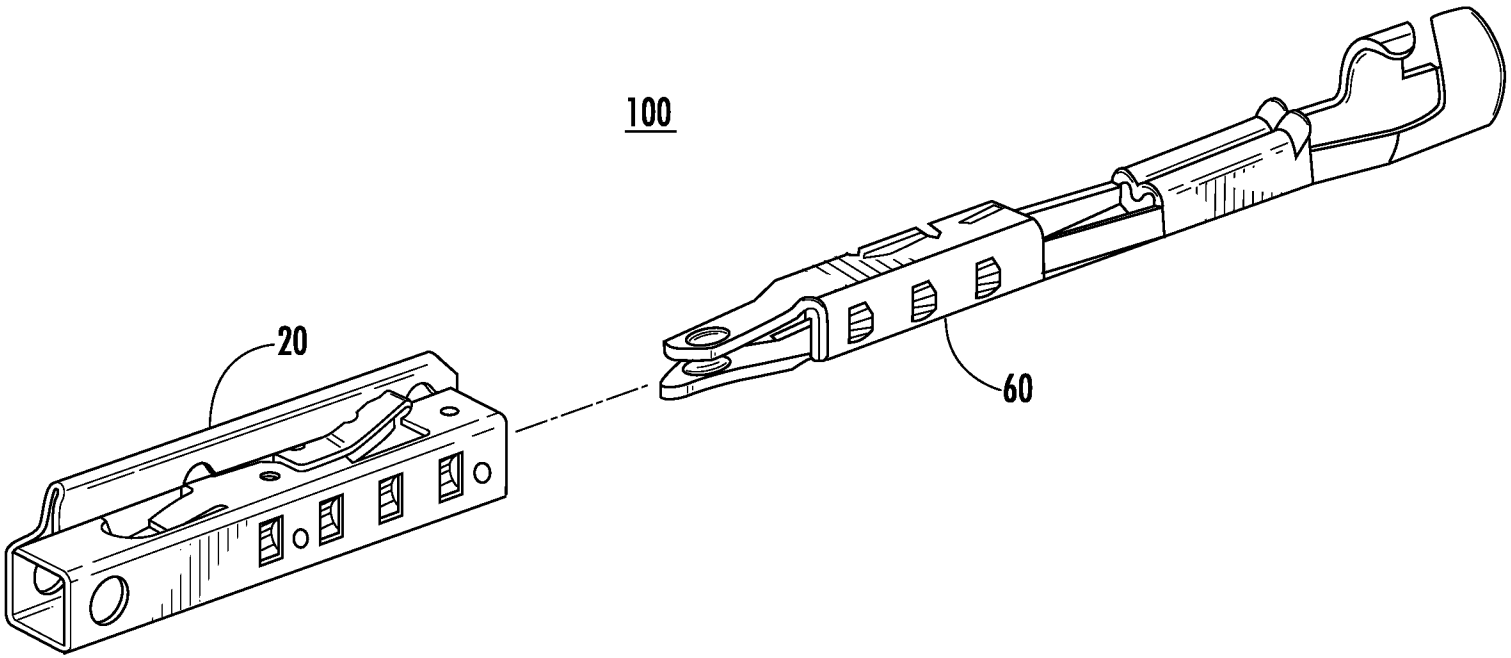
FIG. 2 is an exploded view of the terminal of FIG. 1.
Figure 3:
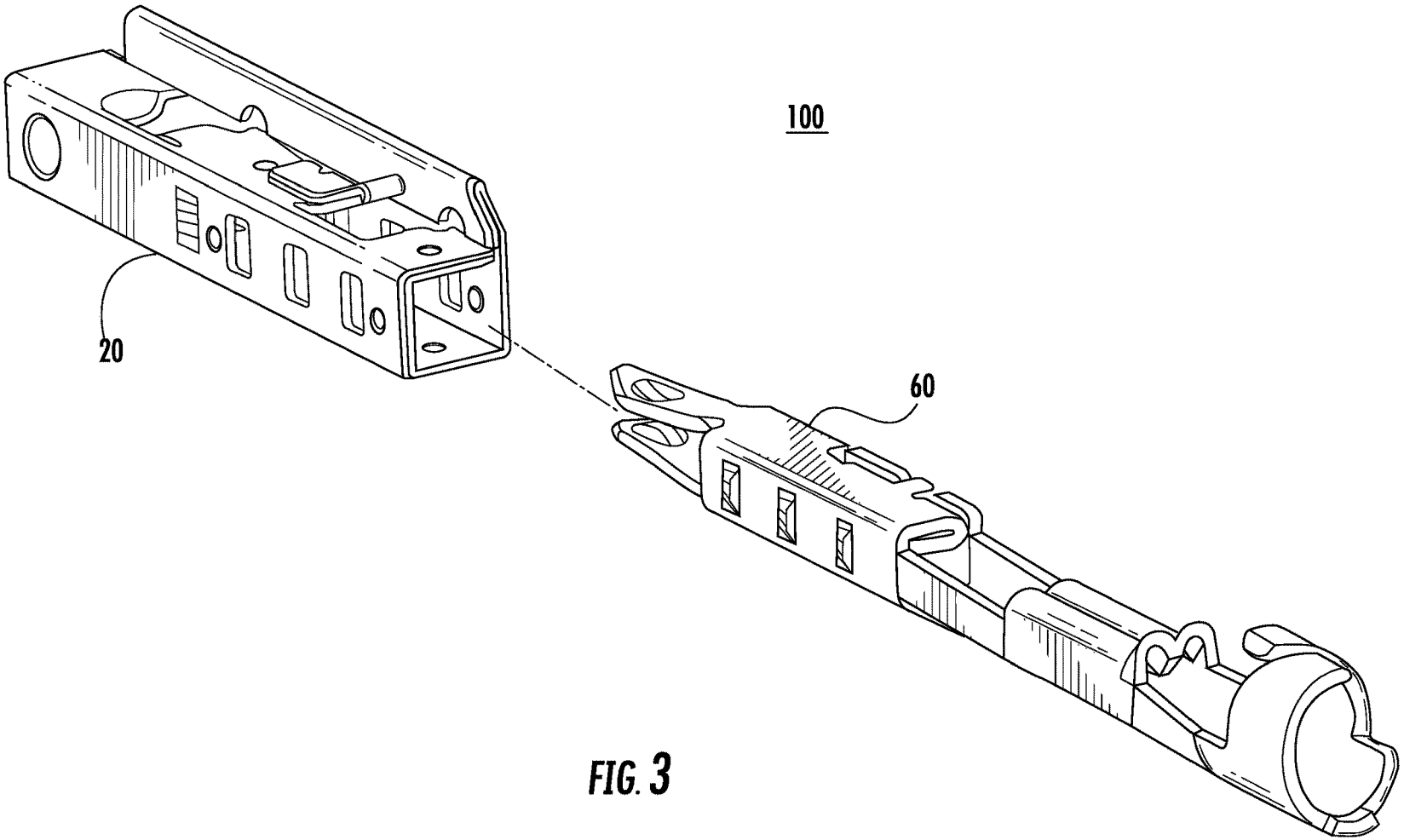
FIG. 3 is an alternate exploded view of the terminal of FIG. 1.

The appended figures illustrate an embodiment of the present disclosure and it is to be understood that the disclosed embodiment is merely exemplary of the disclosure, which may be embodied in various forms. Therefore, specific details disclosed herein are not to be interpreted as limiting, but merely as a basis for the claims and as a representative basis for teaching one skilled in the art to variously employ the present disclosure.

In the embodiment shown, the figures represent a single circuit of a connector. The illustrations for each element of the connector assembly are a single slice or portion of the entire connector assembly. For multiple circuit connectors the following figures represent a single circuit and are identical to each other within the connector assembly.

In the embodiment, as illustrated in the figures, the following description is directed to the connector 10 disposed on the wire harness and all references to the connector 10 are as such. The first end of the wire harness includes a connector 10 having a housing assembly 120 formed from an insulative material and includes a terminated lead assembly 110 for mating with a corresponding connector or receptacle on an electronic device (not shown). The housing assembly 120 and the terminated lead assembly extend along a longitudinal axis A.

The housing assembly 120 includes a molded housing 130 for retaining and securing an electrical terminal fitting 100. The terminal fitting 100 may be configured as either a male pin or blade or a female receptacle fitting for receiving a corresponding male pin or blade. As shown in the FIGS. 1-5 a female terminal fitting 100 is illustrated. The terminal fitting 100 is comprised of two pieces, a first piece or body piece 60 having a wire securing section 80 configured for securing a conductor and also a connection section 70 for providing an electrical connection to a mating terminal fitting; and a second piece or hood piece 20 that encloses the connection portion 70 of the body 60 and further providing retention and reinforcement to the connection section 70. Each piece is formed separately and secured together via a separate assembly or marriage die. The hood 20 is typically aligned to the body 60 then clamped or clinched to body 60.

Figure 4:
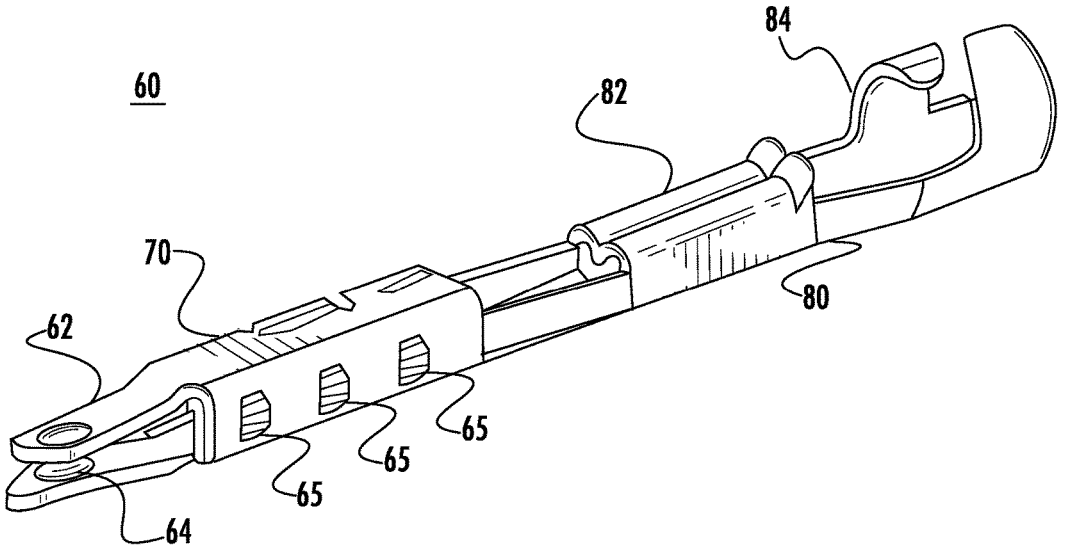
FIG. 4 is a perspective view of the body of the terminal of FIG. 1.
Figure 5:
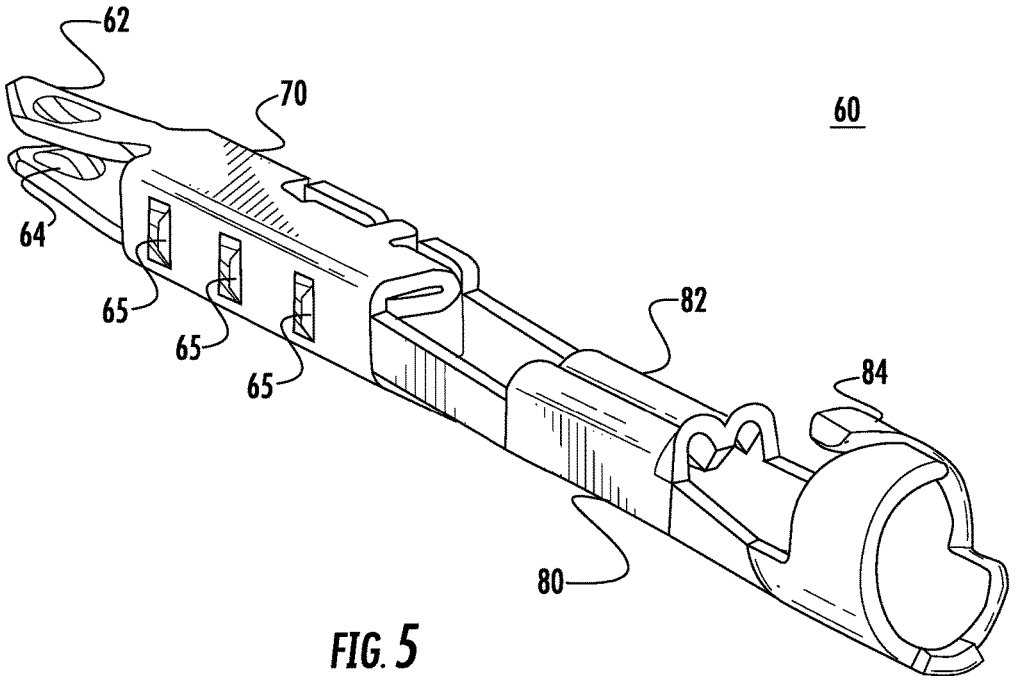
FIG. 5 is an alternative perspective of the body of FIG. 4.
Figure 6:
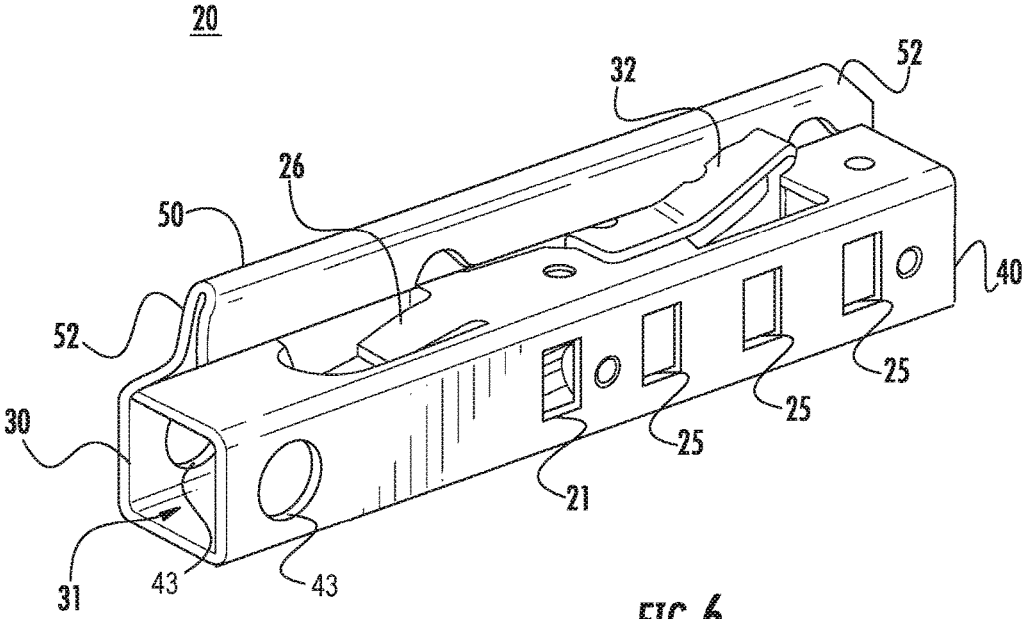
FIG. 6 is a perspective view of the hood of the terminal of FIG. 1.
Figure 7:
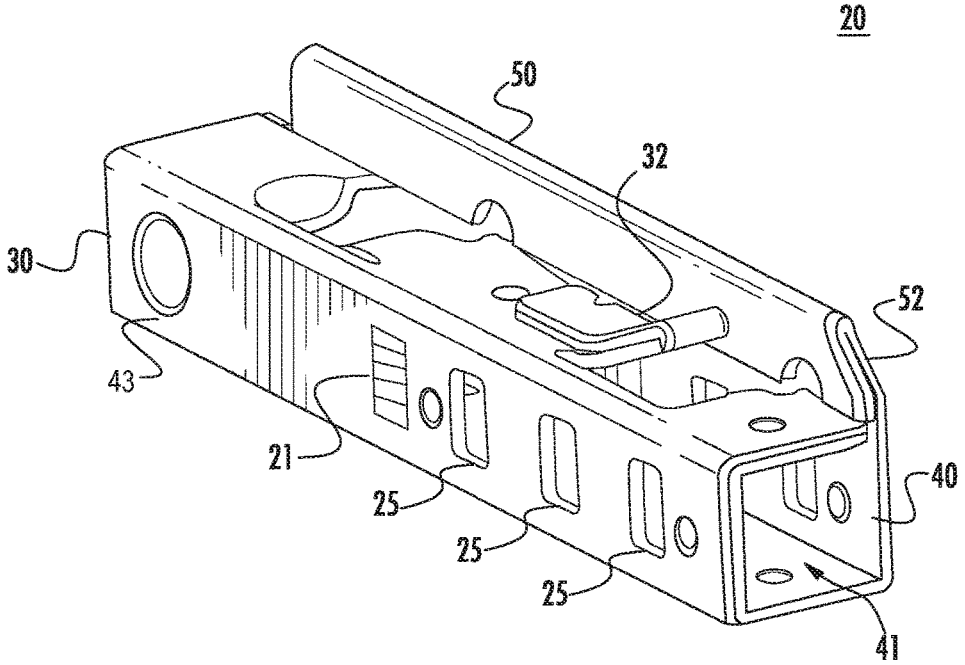
FIG. 7 is an alternative perspective view of the hood of FIG. 6.
Figure 8:
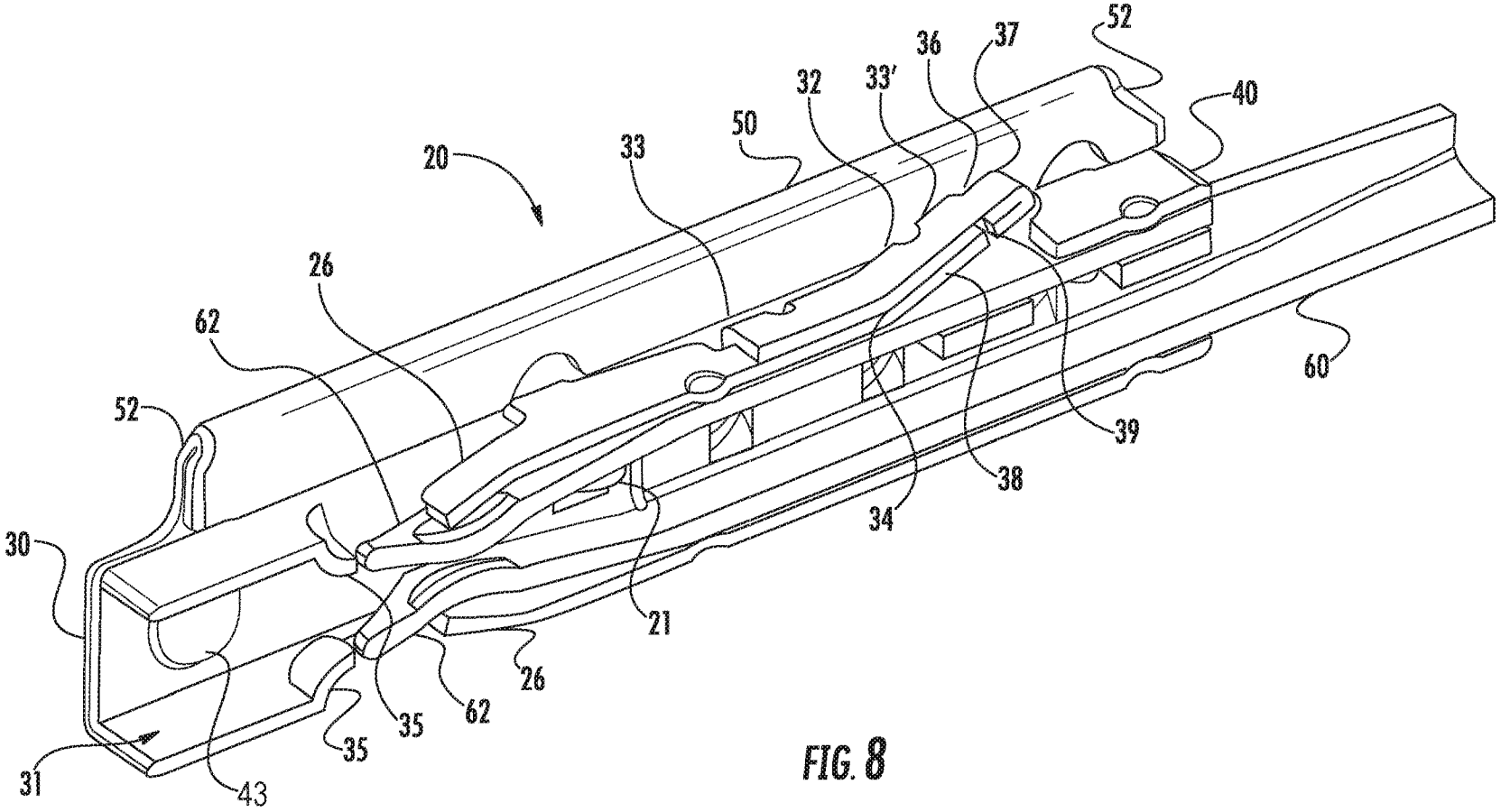
FIG. 8 is a sectional view of the contacting section of the terminal of FIG. 1.
Figure 9:
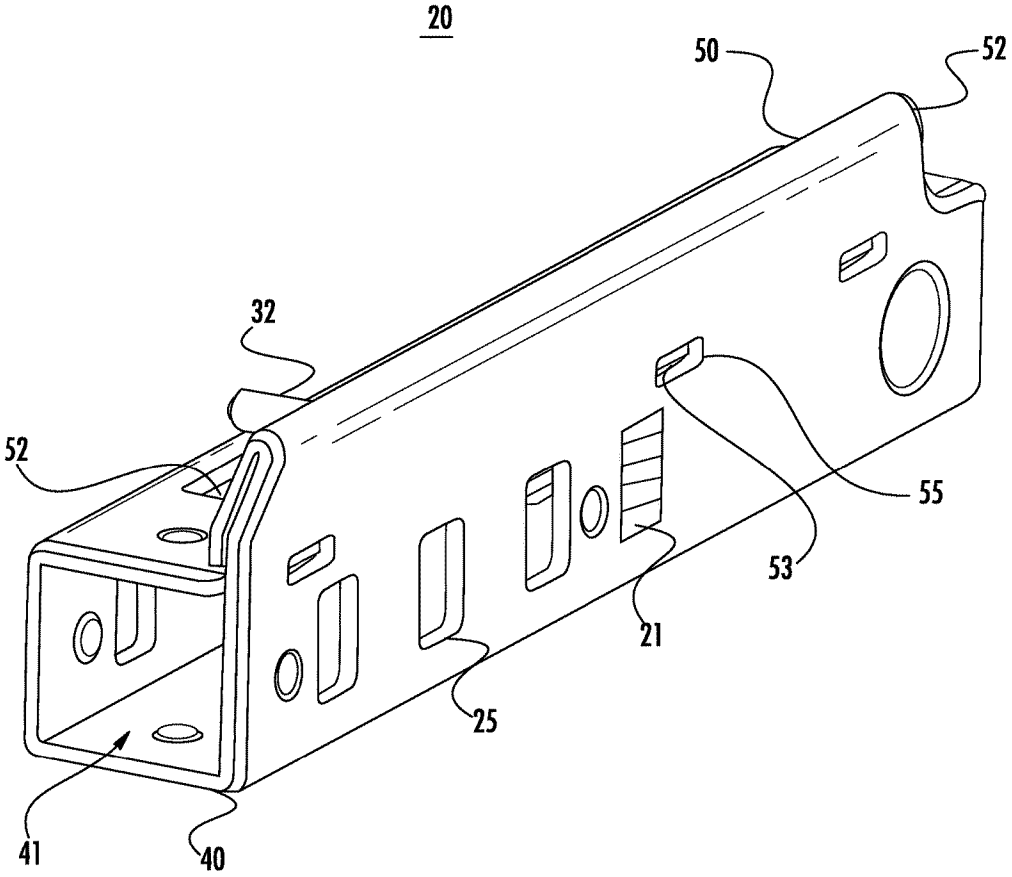
FIG. 9 is an alternative perspective view of the hood of FIG. 6.
Figure 10:
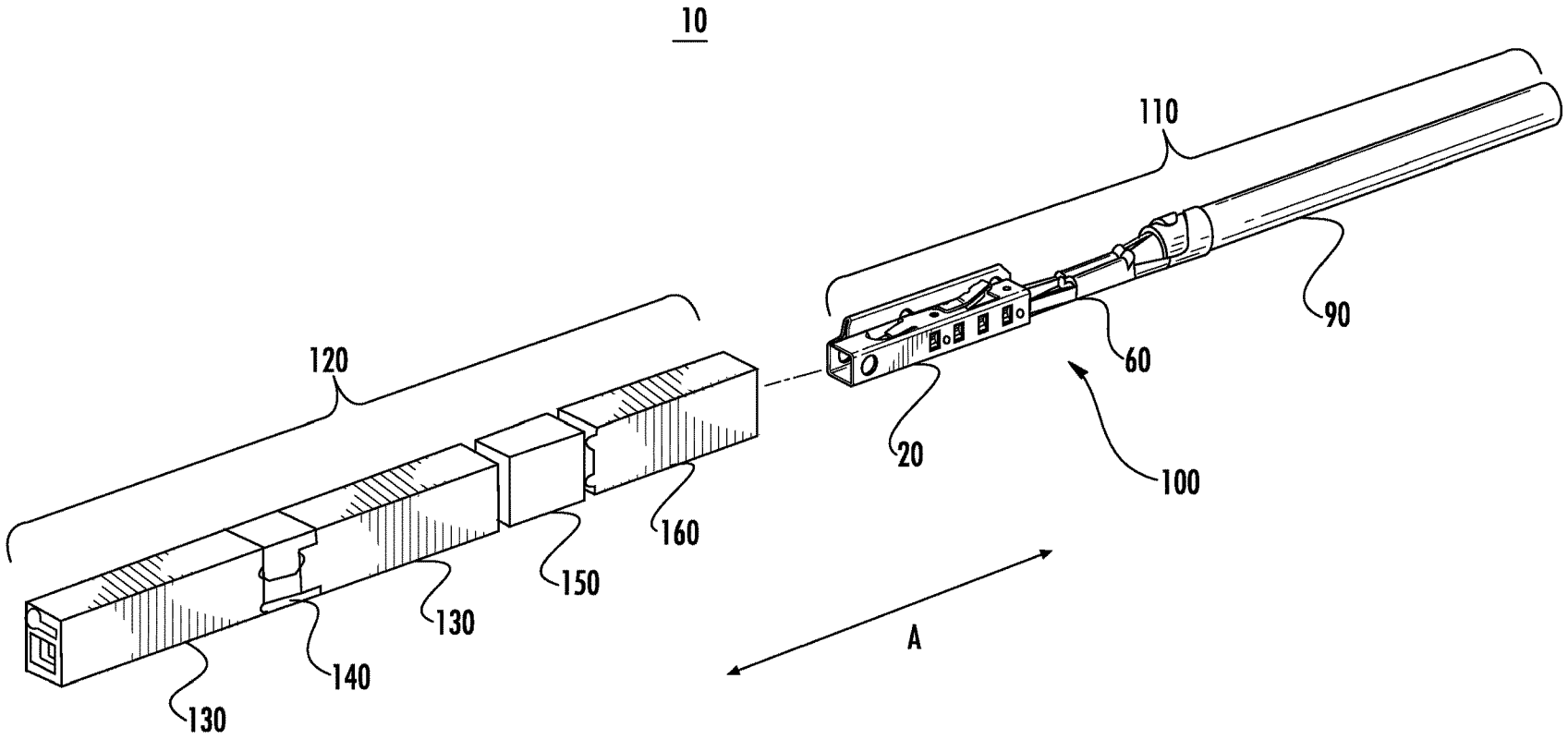
FIG. 10 is an exploded view of the connector with the terminal and a portion of the housing.
Figure 11:
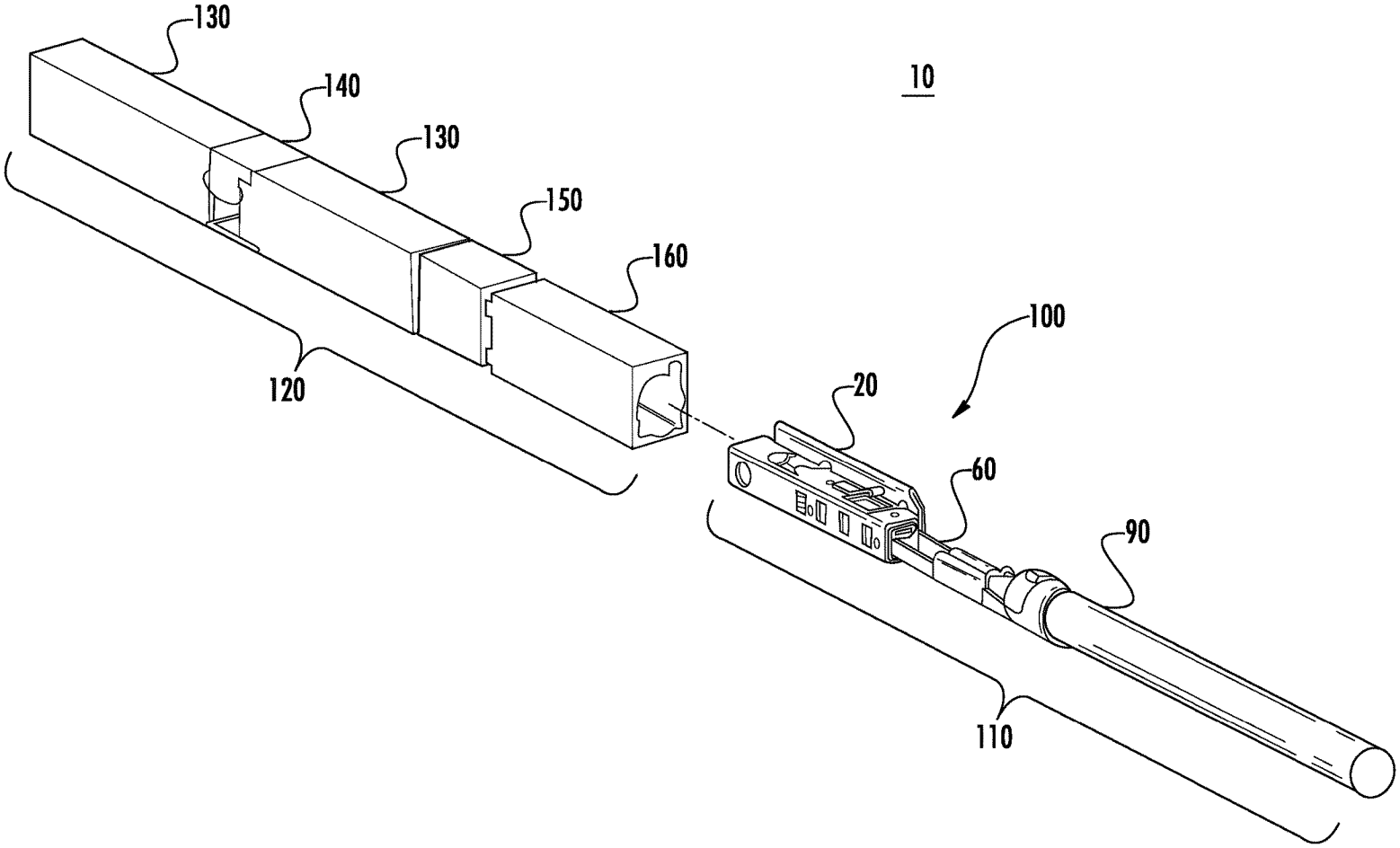
FIG. 11 is an alternative perspective of the connector of FIG. 10.
Figure 12:
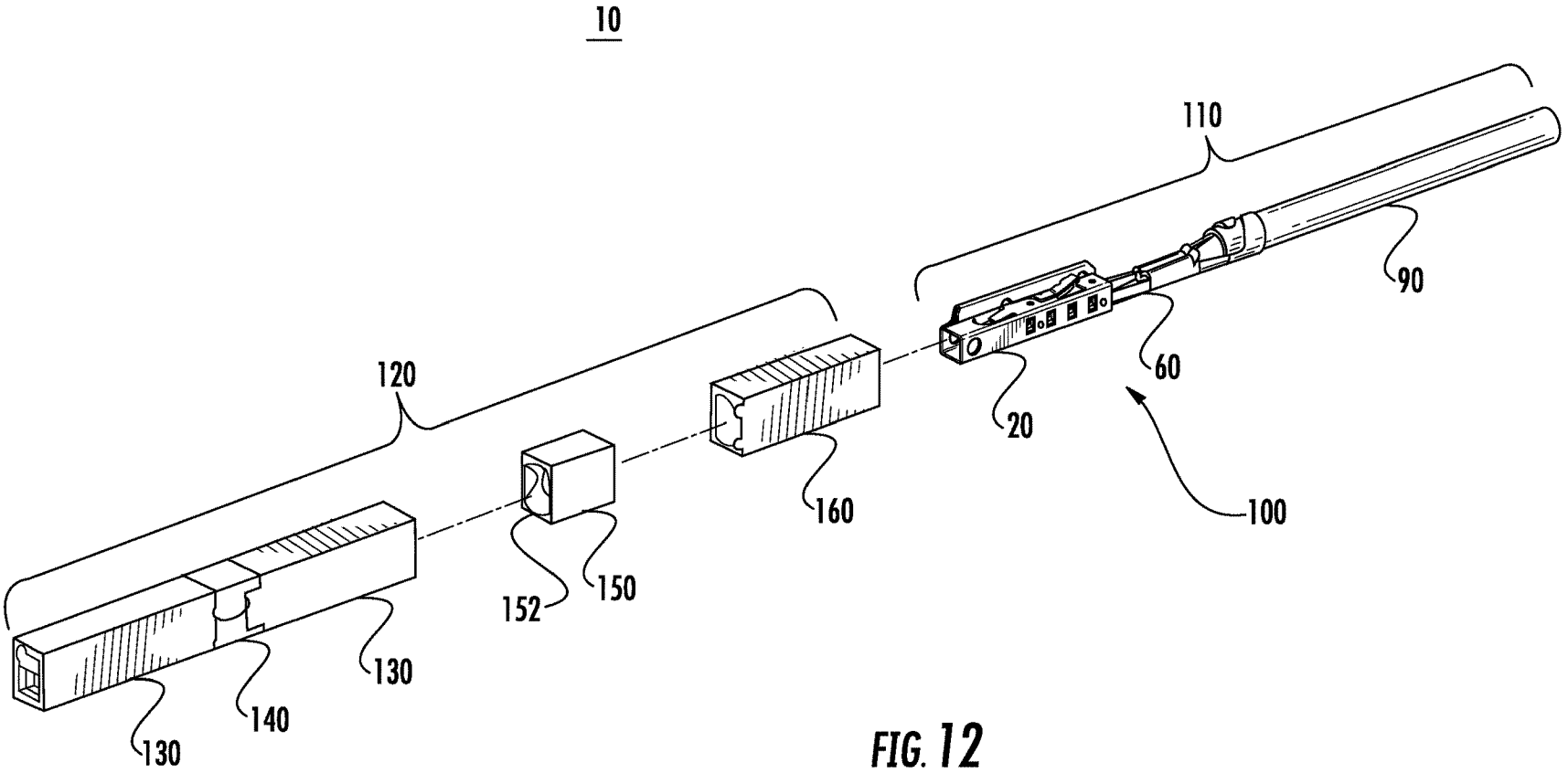
FIG. 12 is a perspective view of the connector FIG. 10 with a partially exploded housing.
Figure 13:
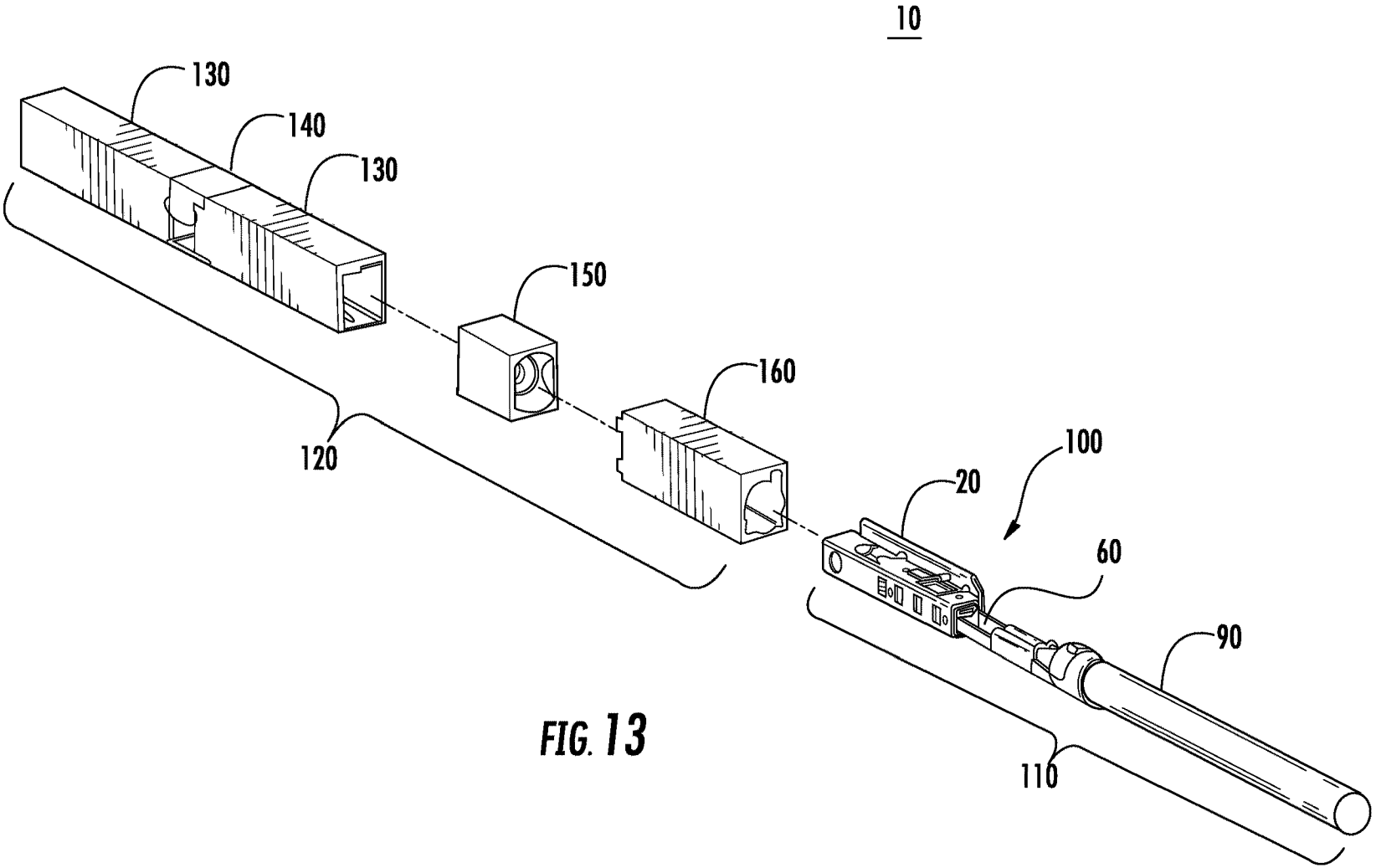
FIG. 13 is an alternative perspective view of the connector of 12.
Figure 14:
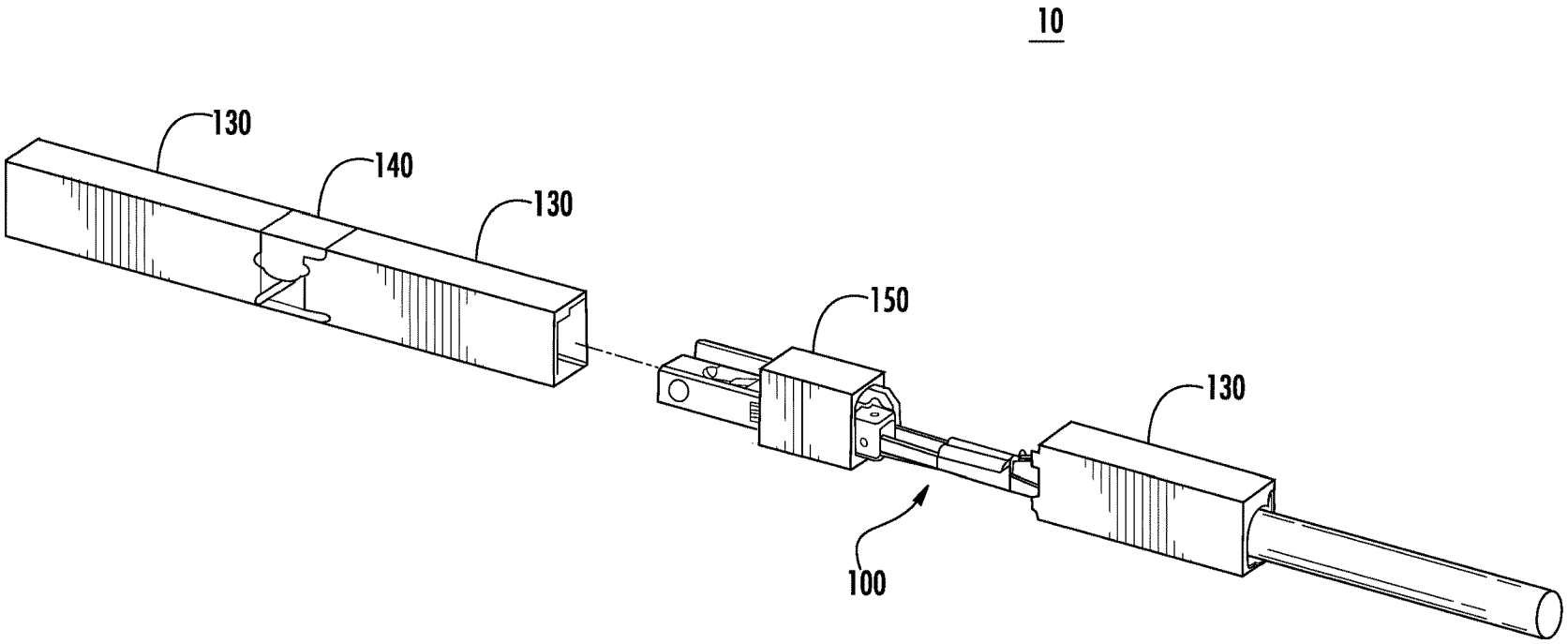
FIG. 14 is a partially exploded view of the connector.
Figure 15:
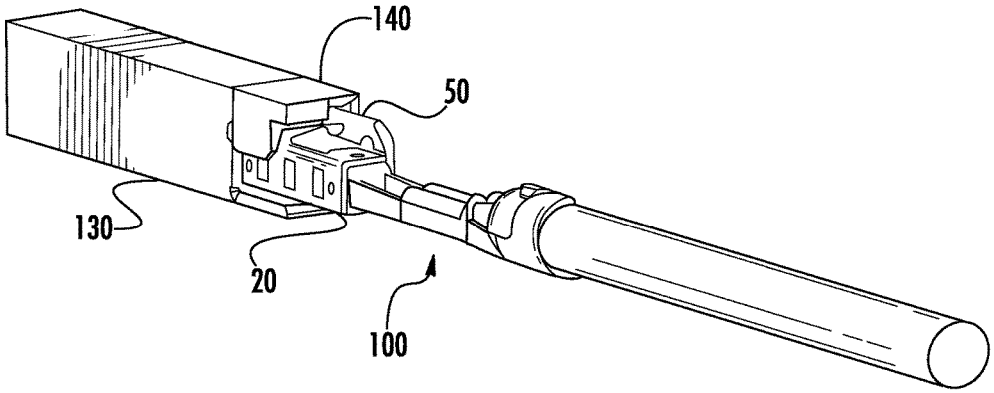
FIG. 15 is a detail view of the terminal during insertion into a portion of the housing.
Figure 16:
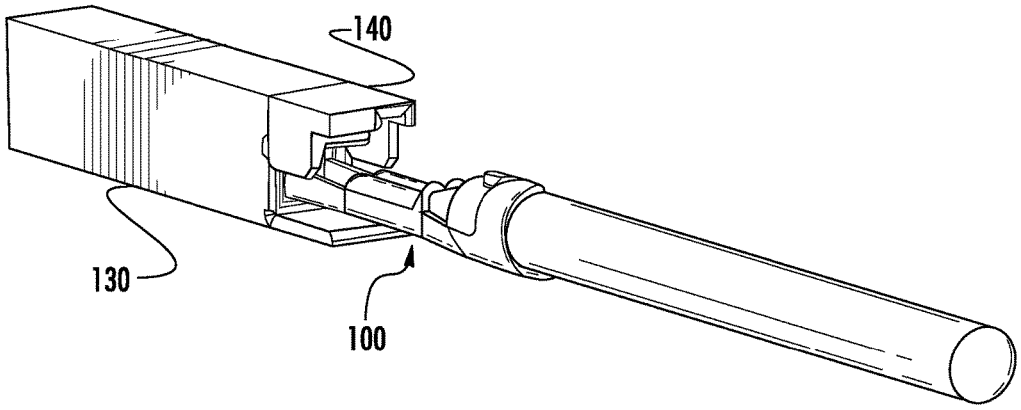
FIG. 16 is another detail view of the terminal during insertion into a portion of the housing.
Figure 17:
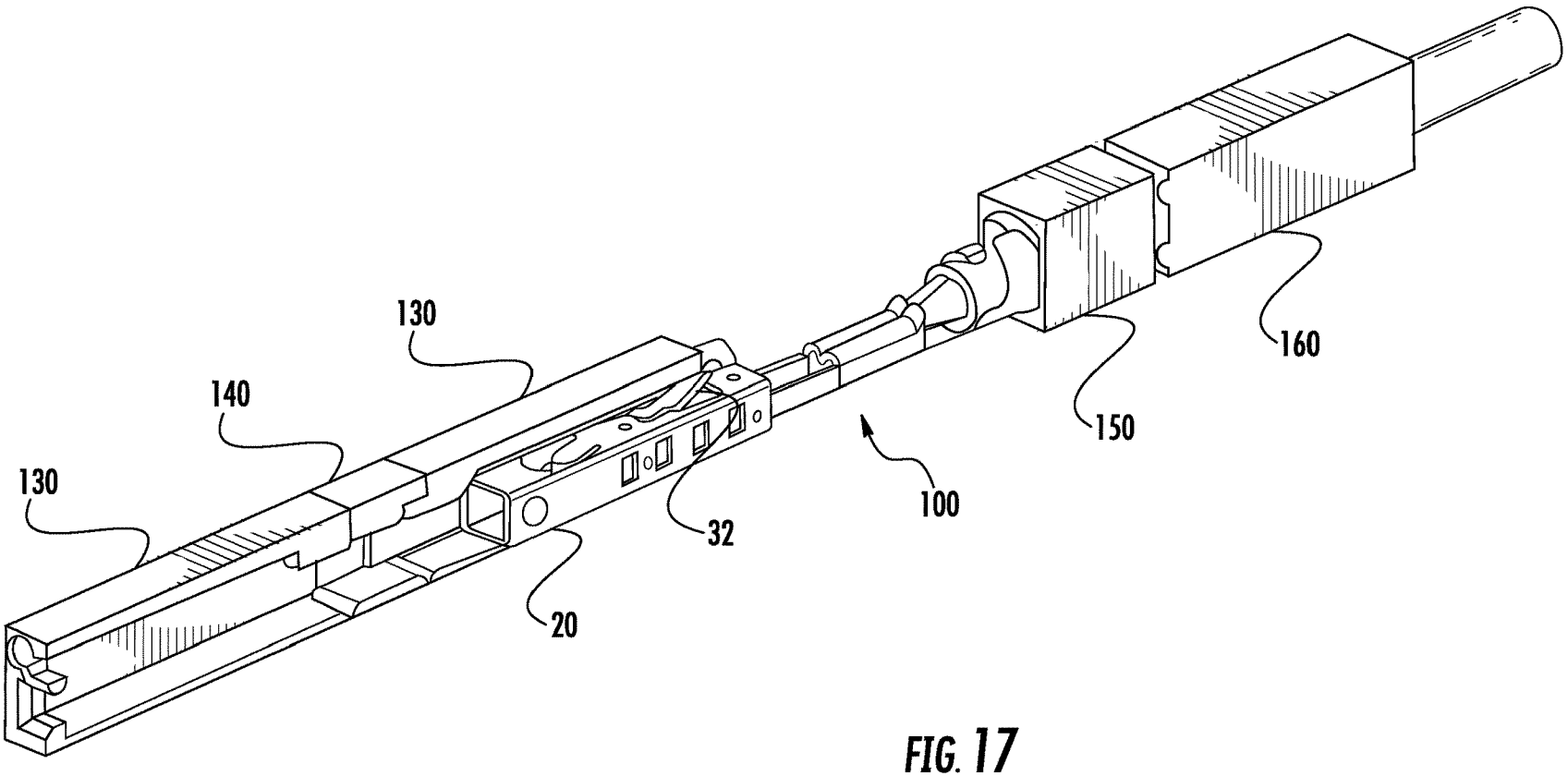
FIG. 17 is a sectional view of the connector with a portion of the terminal inserted into the housing.

As shown in FIGS. 4-5, the body 60 has a connection section 70 formed in a generally square shape and includes a pair of contact portions 62 extending from a first end and a wire securing section 80 extending at a second end comprising a wire securing portion 80. The wire securing portion 80 includes a wire crimp area 82 for connection to a bare wire portion of a lead wire and an insulation crimp portion 84 for connection to the insulated portion of the lead wire 90. The hood 20 as depicted in FIGS. 6-7 is formed from a separate piece of metal and has a generally rectangular shape with a rib 50 extending from a side surface of the hood 20. A locking arm 32 extends from the hood 20 and is positioned adjacent the rib 50. As illustrated in FIG. 8-11 the terminal fitting 100 has a cross-sectional profile to allow for proper installation into corresponding cavities formed in the housing 130 as will be described later.

As further illustrated in FIGS. 4-5 the body 60 includes a connection section 70 positioned at a first end and a wire securing section 80 positioned at a second end of the body 60. The body 60 is stamped and formed from a single piece of an electrically conductive material such as copper or any other copper based alloy or similar material having electrical conducting properties. Formed at the rear or first end of the main body portion is a connecting or termination portion. The connection section 70 is generally box shaped and includes a pair of flexible spring fingers 62 extending along the longitudinal axis A. The spring fingers 62 are generally opposed to each other and include a spaced defined therebetween. A 64 is formed at an end of each spring finger 62 configured to engage a pin of mating connector (not shown). A series of perforations 65 are formed along the side of the body 60 extending outwardly away from the body 60.

The wire securing section 80 is formed at the second end of the body 60 and is configured to receive and secure an electrical lead wire. The wire securing section 80 includes a "U" shaped channel having a first pair of wing portions 82 disposed adjacent the connection section 70 and a second pair of wing portions 84 positioned adjacent the first pair of wing portions 82 and away from the connection section 70. The end of the conductor 90 has a portion of the insulation removed to expose the conductor whereby the bare conductor is placed within the first pair of wing portions 82 and a portion of the unstripped wire is received in the second pair of wing portions 84. The first pair of wings 82 are crimped to a bare wire portion of a lead wire 90 and the second pair of wings are crimped the insulation portion of the lead wire 90 to electrically and mechanically secure the lead wire 90 to the terminal fitting 100.

As best shown in FIGS. 6-7 the hood 20 is formed from a single piece of sheet metal, in the embodiment shown the material is stainless steel. In some instances steel provides additional benefits to copper or copper based alloys. Steel typically exhibits higher tensile strength properties and situations where it is used in spring or biasing applications is a superior choice. The hood 20 is configured to be in the shape of a square and have a similar profile to the body 60 with a front mating end 30 and a rear end 40. The mating end 30 including an opening 31 for receiving a male terminal and a rear end 40 having an opening 41 configured to receive the body 60 along the longitudinal axis A.

The hood 20 further includes an alignment rib 50 extending from the top surface of the hood 20 and along a side surface of the hood 50 and substantially along the entire length of the hood 20. In the embodiment shown, the rib 50 is flush with a side surface of the hood 50, that is, the rib 50 and the side surface of the hood 20 lies on the same plane. A chamfer or tapered surface 52, is formed at ends of the rib 50 adjacent the mating end 30 and rear end 40 of the hood 20 providing a smooth transition and eliminating any sharp corners at the top edge of the alignment rib 50. The tapered end 52 of the 50 adjacent the mating end 30 is spaced rearward along the longitudinal axis A from the mating end 30. The edges of the material that forms the rib 50 and the openings 30, 40 of the hood 20 are coined during the forming process to similarly eliminate any sharp edges or burrs.

To assemble the terminal fitting as illustrated in FIGS. 1-3 and 8, the body 60 is inserted into the rear opening 40 of the hood 20 with the pair of cantilevered spring fingers 62 extending through the rear opening 40 and into the hood 20. It should be noted that the hood 20 is not completely formed, clearance is needed to insert the body into hood 20. The connection section 70 of the body 60 abuts a projection 21 formed in the hood 20 that extends into the interior space of the hood 20 which acts as a stop that limits the forward insertion of the body 60 into the hood 20. As further illustrated in FIG. 8, the hood 20 also provides additional support to the spring fingers 62 of the connection section 70 of the body 60. As previously described, the connection section 70 includes a pair of cantilevered spring fingers 62 extending from the body 20 toward each other with a portion having a dimple 64 for contacting a pin or blade of a mating electrical terminal Secondary stiffening beams 26 formed on the hood 20 engage the cantilevered spring fingers 62 and provide additional support and added stiffness for the spring fingers 62. During insertion of the male terminal the secondary stiffening beams 26 provide additional resistance to the spring fingers 62 to provide increased normal force during electrical engagement of the mating electrical terminals therefore increasing electrical performance of the connection. In the embodiment shown, the hood 20 does not provide any direct electrical contact with the mating terminal fitting but exhibits greater mechanical properties to improve or enhance the electrical properties of the spring fingers 62.

To further locate the body 60 to the hood 20, a plurality of projections 65 extend outwardly from the body 60 that are configured to be received in corresponding apertures 25 formed in the side surfaces of the hood 20 that properly locate and retain the body 60 and hood 20 together. The hood 20 is subsequently crimped or clinched around the body 60 and tabs 53 formed on the top wall of the hood 20 extend into slots 55 formed in the side wall that hold the hood closed and prevent it from springing back.

As best illustrated in FIGS. 6-9, a locking arm 32 is formed in the top wall of the hood 20. The locking arm 32 is formed as a cantilevered beam extending from a point 34 in a direction from the connection section 70 of the terminal fitting 100 to the wire securing section 80. The locking arm 32 is formed from the top wall of the hood 20 and is tapered away from the hood 20. In the embodiment shown the cross-section of the locking arm 32 includes a folded over wall portion along an edge of the locking arm 32 creating a double-walled beam, the beam includes a primary beam 36 and a support beam 38. Additionally, the primary beam 36 and the support beam 38 are in face to face contact with each other. The locking arm 32 generally includes two portions, a horizontal portion 33 and an inclined portion 33'. Other beam cross sections can be appreciated, for instance an "L" shaped cross-section or any cross section that provides an increased resistance to bending. In either case, the folded cross-section adds stiffness to the beam to prevent it from buckling under load. A stop 37 is formed at the free end of the locking arm 32 and protrudes upwardly from the hood and includes a smooth curved folded over portion. An edge surface 39 of the stop 37 is directed back toward the support beam 38 so that the edge 39 is not exposed. The stop 37 forms a surface for the locking arm 32 that engages a cooperating surface in the housing 130 upon insertion of the terminal fitting 100 into the connector housing 130.

The mating end 30 of the hood 20 includes an opening 31 for receiving a corresponding male pin of a cooperating connector (not shown) therein. The opening 31 has a pair of opposing sidewalls with each opposing side wall having a raised projection 43 positioned across the opening 31 from each other. Upon mating, the projections 43 provide proper alignment of the male terminal or pin as it enters the mating opening 31. The side walls are connected to each other by corresponding top and bottom walls. The top and bottom walls include a second pair of opposing projections 35 positioned directly in front of the cantilevered spring fingers 62 of the connection section 70 and behind or rearward of the projections 43 in the side walls. The second pair of projections 35 formed in the top and bottom walls also provide an anti-stub feature so that the male terminal does not contact the leading edge of the spring fingers 62 and is properly located in position to engage the contacting dimples 64 of the spring fingers 62 of the terminal fitting 100 during mating.

The connector assembly 10 includes a connector body 120 having a housing 130, an independent secondary lock, ISL 140, a seal 150 and a seal cover 160. The ISL 140 is disposed in a slot formed in the housing 130 and the seal is place in a pocket in the rear portion of the housing 130 with the seal cover 160 holding the seal 150 to the housing 130. In the embodiment shown, the terminal assembly 110 is inserted into cavities formed in a connector housing 130. As best illustrated in FIGS. 10-13 the cavity is formed in a corresponding shape of the exterior envelop shape of the terminal fitting 100. This shape is similarly formed in the seal cover 160, the housing 130 and the ISL 140. An aperture 152 formed in the seal 150 is circular in shape and has a diameter that is smaller than the outer diameter of the lead wire. The aperture 152 in the seal 150 includes lips or bladders that provide a resilient interface between the seal 150 and the insulation portion of the lead wire 90 providing a moisture/debris resistant barrier.

Figure 18:
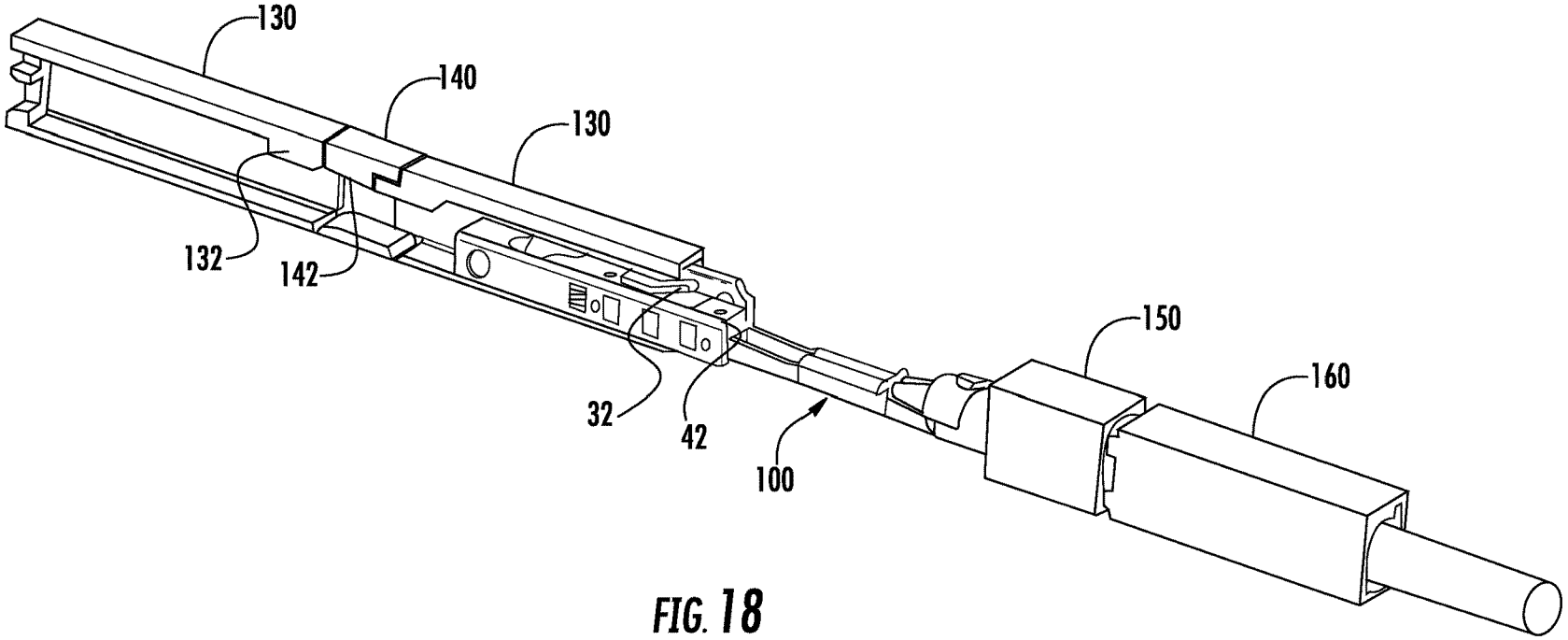
FIG. 18 is an alternative perspective view of the connector of FIG. 17.
Figure 19:
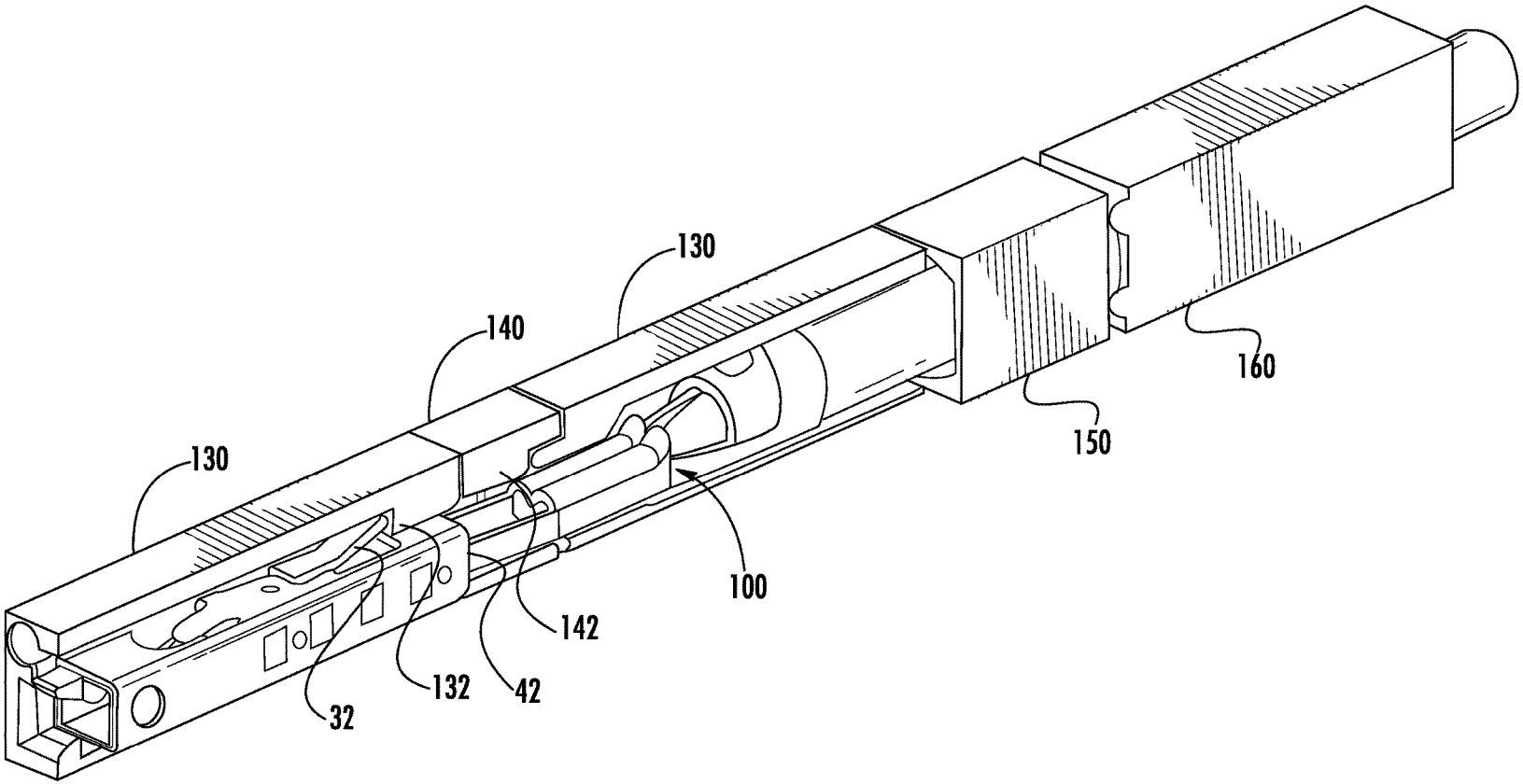
FIG. 19 is a partial section view of the connector with the terminal fully installed.
Figure 20:
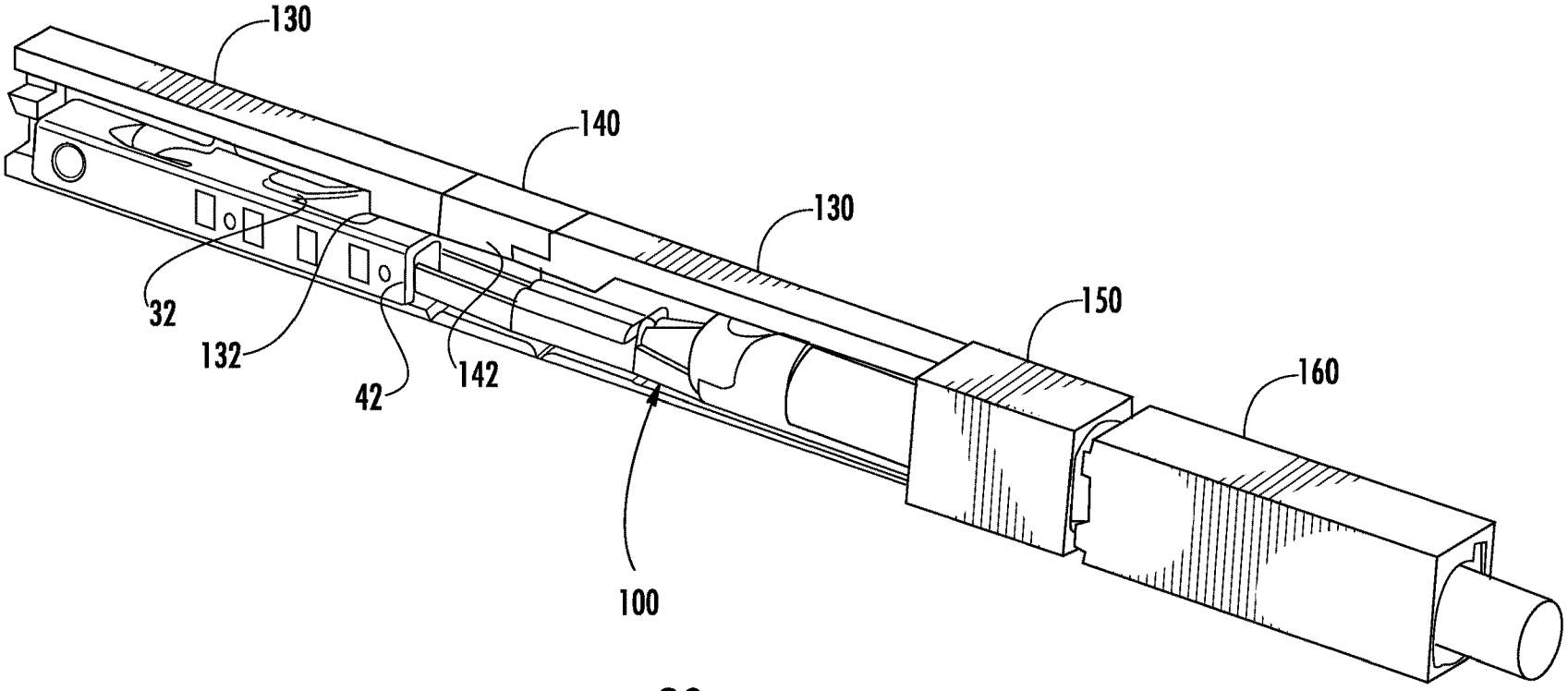
FIG. 20 is an alternative perspective view of the connector of FIG. 19.

During assembly, the terminal lead assembly 110 is inserted from the rear portion of the housing assembly 120 with the aligning rib 50 formed on the hood 20 being inserted into a corresponding guide-way formed the cavity portion in the seal cover 160. As best shown in FIGS. 14-20 the terminal lead assembly 110 is advanced through the cavity until the mating end 40 of the hood 20 abuts an inner surface of the front portion of the cavity formed in the housing 130. During this operation, the locking arm 32 formed on the hood 20 is deflected inward as the terminal fitting 100 passes the retention shoulder 132 formed in the cavity as best shown in FIG. 18. Once the locking arm 32 passes the shoulder 132, the locking arm 32 springs back and the stop 37 formed on the retention beam engages the shoulder 132 securing the terminal fitting 100 in the cavity and the terminal lead assembly 110 in the connector housing assembly 120.

After being completely inserted into the housing 130, the stop 37 formed on the hood 20 of the terminal fitting 100 abuts a shoulder or recess 132 formed in the cavity and the terminal lead assembly 110 resists pull out from the housing. The rounded end of the stop 37 provides a smooth surface area to engage the complimentary surface of the shoulder 132 formed in the terminal cavity, whereby the smooth portion area of the stop 37 prevents the locking arm 32 from digging into the cavity when an extraction force is applied to the terminal lead assembly 110 and preventing permanent damage to the terminal cavity while maintaining and securing the terminal fitting 100 within the cavity even under extreme pull out or extraction forces. Additionally the aligning rib 50 provides a measure of protection so that wires or the like cannot catch or snag on the locking arm 32 during normal handling and damage it prior to assembly.

Figure 21:
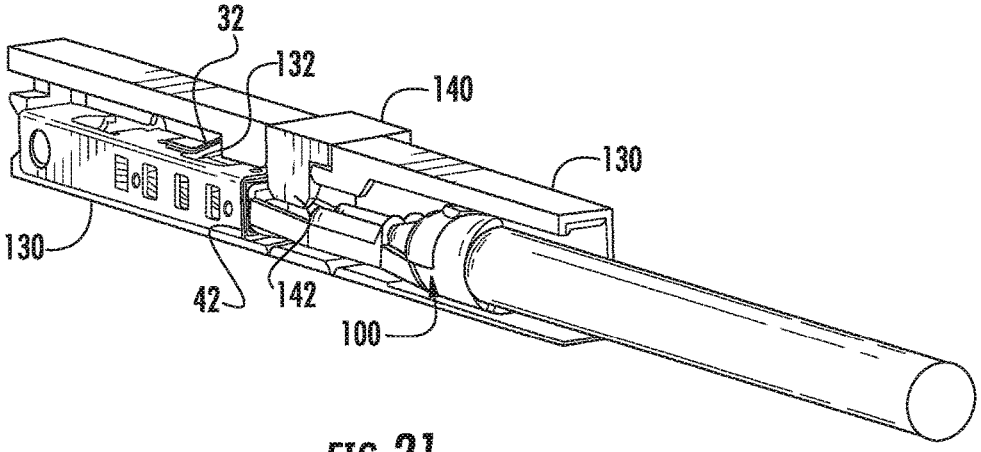
FIG. 21 is a section view of the connector with the terminal fully installed.
Figure 22:
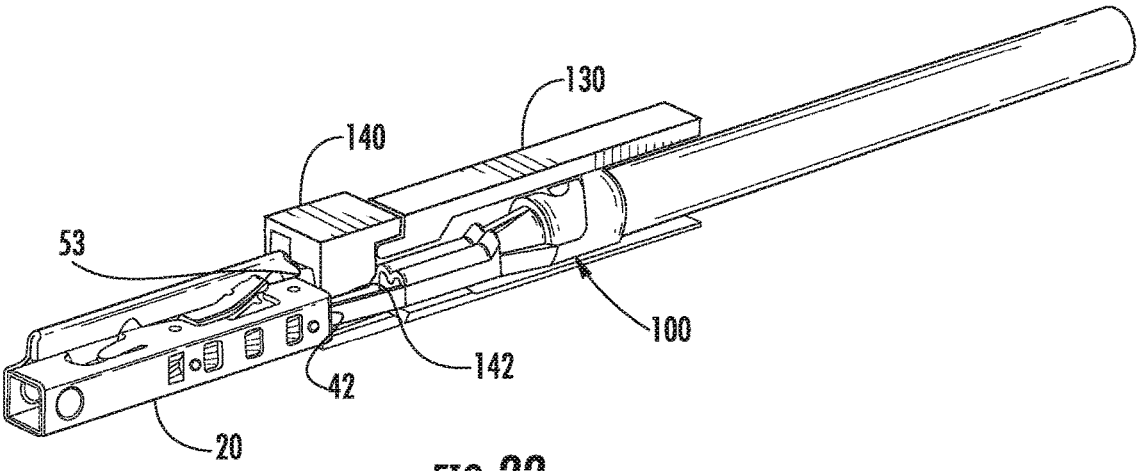
FIG. 22 is a partial section view of the connector with the mating portion of the housing removed.

To further secure the terminal lead assembly 110 in the cavity, upon complete insertion of the terminal fitting 100, the ISL 140 is displaced laterally such that a secondary shoulder 142 is moved behind the rear edge of the hood 42. The secondary shoulder 142. prevents any rearward movement of the terminal fitting 100 as best illustrated in FIGS. 21-22. The ISL 140 is first positioned in a free position which allows the terminal fitting to pass through the body of the ISL 140. The ISL 140 is held in the first position by detents and cannot be moved without force. Once the terminal fitting 100 passes through the ISL 140, the ISL 140 is moved laterally from the free position to a locked position which locks the terminal fitting 100 in the cavity. The ISL 140 is held in the lock position by similar detents and cannot be moved without force.

Figure 23:
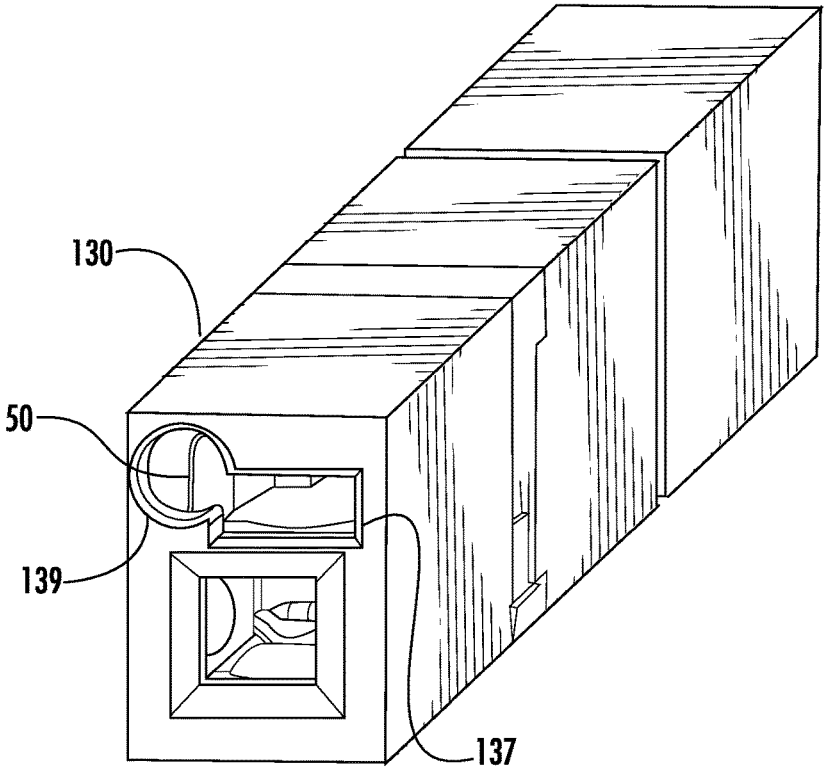
FIG. 23 is a perspective view of the connector.
Figure 24:
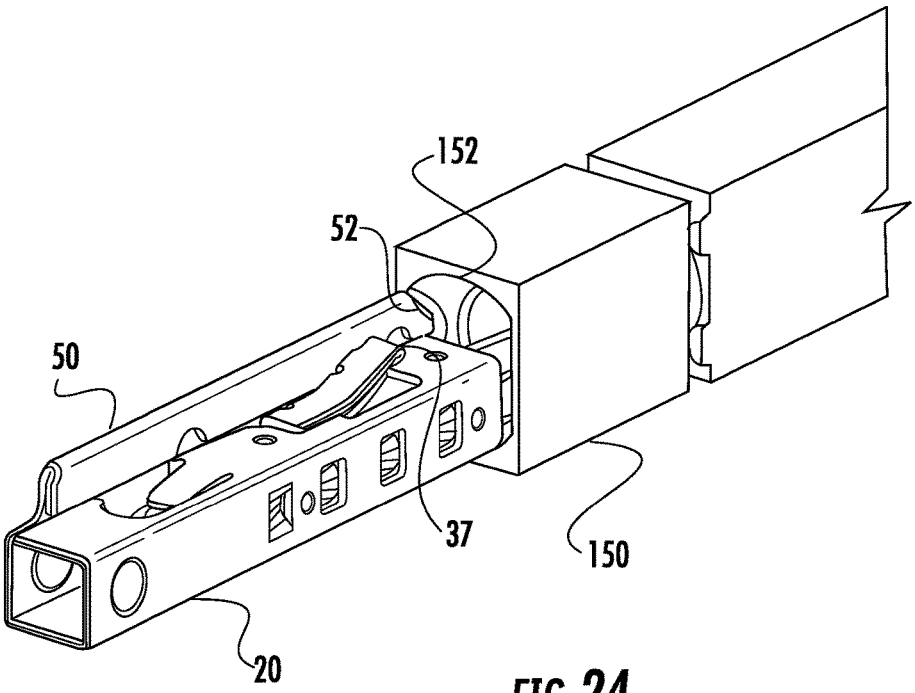
FIG. 24 is a detail perspective view of the terminal with the seal and seal cover in place.

Once the terminal fitting 100 is fully inserted into the cavity and locked with the ISL 140, the terminal fittings 100 held within the housing can be verified for terminal presence by testing. This is accomplished by a test probe being inserted through a detection hole 139 formed in the mating or front surface of the housing 130 as shown in FIG. 23. The probe is inserted into the detection hole 139 and terminal conductivity can be check by electrically connecting the probe to the aligning rib 50 formed on the hood 20 of the terminal lead assembly 110.

In certain circumstances, a terminal fitting 100 of a connector assembly 10 may be defective or the connector assembly 10 needs to be serviced. In these cases it is necessary to remove the terminal lead assembly 110 from the connector housing 130. To remove the terminal fitting 100, the ISL 140 must be moved back to the free position so that the terminal fitting 100 can be withdrawn back through the ISL 140. In addition to this, the locking arm 32 must be deflected away from the shoulder 132 in the housing 130 and free from engagement. This is accomplished by inserting a terminal removal tool (not shown) into a service opening 137 formed in the front of the housing 130 and inserting the tool to deflect the locking arm 32. Once the locking arm 32 is free of the shoulder 132 the terminal fitting 100 can be withdrawn from the cavity in the connector housing 130.

In certain instances, the process of removing the terminal fitting 100 can unintentionally damage certain parts of the connector assembly 10, namely the seal 150. In the sense that the seal 150 is made from a compliant resilient material, it can be prone to tearing or ripping. In this case, it is necessary to remove any sharp edges that may come in contact with the seal that can cause this. As best shown in 24 the alignment rib 50 has a tapered edge 52 that upon withdraw can easily compress the inner diameter 152 of the seal away from the rib so that the terminal can be removed with damaging the inner lips and glands of the seal 150 to preserve its integrity. Additionally, the stop 37 formed on the locking arm 32 has a rounded end which also prevents tearing when this area passing back through the aperture 152 in the seal 150. The seal 150 may then be reused upon reinsertion of the repaired terminal lead assembly 110. A similar taper is also formed on the front end the aligning rib 50 and the mating end 70 of the hood 20 to prevent damage to the seal upon insertion of the terminal fitting 100.

It should be noted that, in general, while plug connectors and receptacle receptors have been described as having certain features, the depiction of whether a connector is a plug or receptacle type in the figures is done merely for illustrative purposes. Therefore, it is envisioned that a particular connector could be configured to be a plug or a receptacle type or a combination of plug and receptacle, as desired. Therefore, unless specifically noted, the determination of whether a contact is a receptacle or plug is not intended to be limiting. It should also be noted that directions such as top, bottom, front and rear are arbitrary and are used to provide a clearer understanding of the embodiments shown.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations.

We claim:

1. A terminal comprising:

a body, the body formed of a first material, the body having a longitudinal insertion axis and having a connection section along an end portion of the terminal and a wire securing portion extending away from the connection section, the connection section having a flexible contact beam, the wire securing portion having a wing; and a hood, the hood formed of a second material, the hood operatively fixed to the body, a rib formed on the hood, the hood having a mating end, a locking arm extending from the hood, the locking arm includes a primary beam and a support beam, the locking arm is cantilevered from the hood and positioned adjacent the rib, the locking arm having a stop, the stop formed at an end of the primary beam and having a curved end, the curved end includes a portion of the primary beam folded over toward the support beam, the rib having a front portion and a rear portion, the front portion is spaced from the mating end of the hood, the front portion and the rear portions having a tapered section.

2. The terminal of claim 1, wherein the locking arm includes a primary beam having a horizontal portion and an inclined portion.

3. The terminal of claim 2, wherein the support beam extends from a point and is layered against the inclined portion of the primary beam.

4. The terminal of claim 3, wherein the primary beam is folded from the support beam in a direction generally along the longitudinal insertion axis.

5. The terminal of claim 4 wherein the inclined portion of the primary beam and the support beam are in face to face contact.

6. The terminal of claim 4 wherein the stop is formed at an end of the primary beam.

7. The terminal of claim 5, wherein an end edge surface of the stop is directed toward the support beam.

8. The terminal of claim 1, wherein the hood is clinched to the body.

9. A terminal comprising:

a body, the body having a connecting end including a contact and a mounting end, the mounting end configured to secure a lead wire;

a hood, the hood attached to the body, the hood having a mating end, the hood further including a rib, the rib having a first end spaced from the mating end and a second end, the first and second ends are being tapered, the hood further including a locking arm, the locking arm is positioned next to the rib, the locking arm is formed from a pair of beams arranged in a face to face relationship and includes a stop, the stop has a rounded end and wherein the stop further includes a folded over portion.

10. The terminal of claim 9, wherein the body is formed from a first material and the hood is formed from a second material.

11. The terminal of claim 10, wherein the tensile strength of the second material is greater than the tensile strength of the first material.

12. The terminal of claim 9, wherein the pair of beams forming the locking arm includes a primary beam and a support beam.

13. The terminal of claim 12, wherein the primary beam includes an inclined portion and a horizontal portion joined at a point.

14. The terminal of claim 13, wherein the horizontal portion and the inclined portion are connected at the point.

15. The terminal of claim 14, wherein the support beam extends from the point and is layered against the inclined portion of the primary beam.

16. The terminal of claim 15, wherein the support beam is folded from the inclined portion of the primary beam along an edge.

17. A connector comprising:

a housing, the housing formed from an insulative material, the housing including a cavity, the cavity including a shoulder, the housing further include a pocket;

a terminal, the terminal having a body and a hood, the hood includes a rib extending along a side portion of the hood, the rib having tapered ends, the hood further includes a locking beam, the locking beam having a cantilevered portion extending from a first point, the locking been further includes a primary beam and a support beam, a stop having a curved end is formed at an end of the primary beam, a seal, the seal positioned within the pocket, the seal including an aperture, the aperture aligned with the cavity; and wherein upon insertion and withdraw of the terminal with the housing, the tapered ends of the rib and the curved end of the stop engage the aperture formed in the seal in a smooth manner.

18. The connector of claim 16, wherein the hood includes a mating end and the rib is spaced apart from the mating end.

* * * * *